US006827555B2

(12) United States Patent
Yang

(10) Patent No.: US 6,827,555 B2
(45) Date of Patent: Dec. 7, 2004

(54) COOLING FAN WITH CURVED V-SHAPED IMPELLERS

(75) Inventor: Sheng-An Yang, Kaohsiung Hsien (TW)

(73) Assignee: Sheng-Shyan Yang, Kaohsiung (TW)

( * ) Notice: Subject to any disclaimer, the term of this patent is extended or adjusted under 35 U.S.C. 154(b) by 33 days.

(21) Appl. No.: 10/328,888

(22) Filed: Dec. 24, 2002

(65) Prior Publication Data

US 2003/0118449 A1 Jun. 26, 2003

(30) Foreign Application Priority Data

Dec. 26, 2001 (TW) ..... 90222862 U

(51) Int. Cl.[7] ..... F01D 5/14
(52) U.S. Cl. ..... 416/197 R; 416/243
(58) Field of Search ..... 415/198.1, 220, 415/224; 416/243, 223 R, 242, 248, 182, 197 R

(56) References Cited

U.S. PATENT DOCUMENTS 537,582 A * 4/1895 Poole ..... 416/197 R
4,484,860 A * 11/1984 Brenholt et al. ..... 416/182
6,318,964 B1 * 11/2001 Yang ..... 416/185
6,572,336 B2 * 6/2003 Horng et al. ..... 416/183
6,699,013 B2 * 3/2004 Zweighaft et al. ..... 416/182

* cited by examiner

*Primary Examiner*—Edward K. Look
*Assistant Examiner*—Richard A Edgar
(74) *Attorney, Agent, or Firm*—Alan D. Kamrath; Nikolai & Mersereau, P.A.

(57) ABSTRACT

A cooling fan includes a rotatable hub and a plurality of generally V-shaped impellers that are angularly displaced from each other and that extend outwardly from the hub. Each of the impellers has first and second impeller halves that extend outwardly from the hub and that are connected to each other so as to form cooperatively an angle therebetween.

4 Claims, 6 Drawing Sheets

COOLING FAN WITH CURVED V-SHAPED IMPELLERS

CROSS-REFERENCE TO RELATED APPLICATION

This application claims priority of Taiwanese Application No. 090222862, filed on Dec. 26, 2001.

BACKGROUND OF THE INVENTION

1. Field of the Invention

This invention relates to a cooling fan, more particularly to a cooling fan with curved V-shaped impellers.

2. Description of the Related Art

FIG. 1 illustrates a conventional centrifugal cooling fan 50 for a notebook computer (not shown) The centrifugal cooling fan 50 includes a casing 51 and a plurality of impellers 501 extending outwardly and curvedly from a hub 502 which is mounted rotatably in the casing 51. The root of each of the impellers 501 extends in an axial direction relative to the hub 502. Since the centrifugal cooling fan 50 is used for a notebook computer and is thus relatively small, the impellers 501 are relatively short. As a consequence, air flow in the region swept by the rotating impellers 501 is relatively small. Moreover, the centrifugal cooling fan 50 tends to generate a relatively large amount of eddy currents in the casing 51, which significantly reduces the air density of the air flow delivered by the fan 50.

FIG. 2 illustrates a conventional axial cooling fan 60 that includes a casing 61 and a plurality of impellers 601 extending outwardly and curvedly from a hub 602 which is mounted rotatably in the casing 61. Each of the impellers 601 is inclined relative to the axis of the hub 602. Since the casing 61 has a depth that is relatively short, the air flow introduced by the impellers 601 will impact the casing 61 and will bounce back and forth in the casing 61, thereby significantly reducing the cooling efficiency of the fan 60.

U.S. Pat. No. 6,318,964 discloses an axial cooling fan that includes a hub having interconnected first and second hub halves, and a plurality of first and second impeller halves. Each first impeller half extends outwardly from the first hub half. Each second impeller half extends outwardly from the second hub half, and is connected to a respective one of the first impeller half in such a manner that both the first and second impeller halves are inclined relative to the axis of the hub in the same direction. The cooling fan thus disclosed has the same disadvantage as the conventional axial cooling fan.

SUMMARY OF THE INVENTION

Therefore, the object of the present invention is to provide a cooling fan with a plurality of V-shaped impellers that are capable of overcoming the aforementioned drawbacks of the prior art.

According to the present invention, there is provided a cooling fan that comprises: a rotatable hub; and a plurality of generally V-shaped impellers that are angularly displaced from each other and that extend outwardly from the hub. Each of the impellers has first and second impeller halves that extend outwardly from the hub and that are connected to each other so as to form cooperatively an angle therebetween.

BRIEF DESCRIPTION OF THE DRAWINGS

In drawings which illustrate an embodiment of the invention.

DETAILED DESCRIPTION OF THE PREFERRED EMBODIMENT

Figure 3:
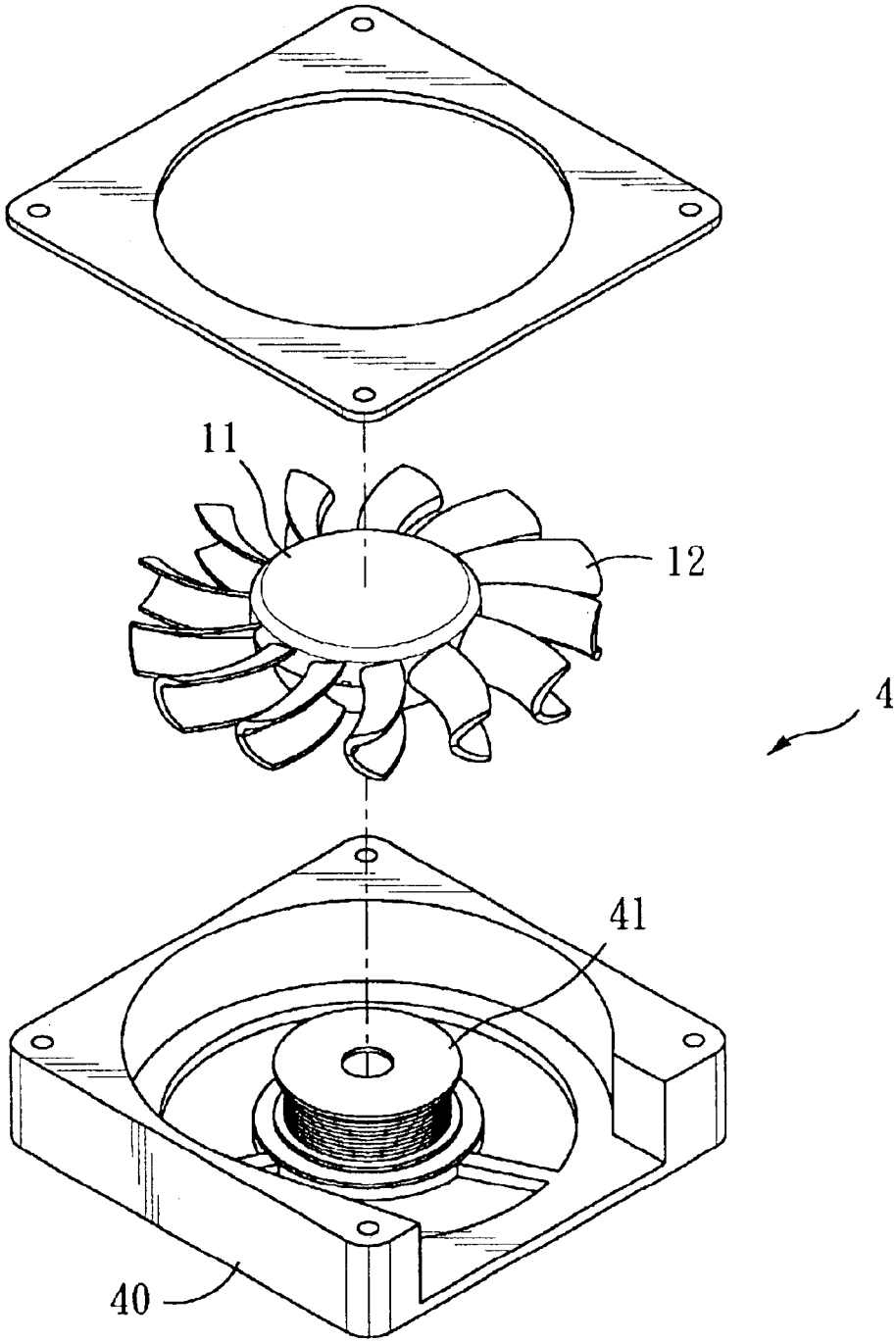
FIG. 3 is an exploded perspective view of a cooling fan embodying this invention.
Figure 4:
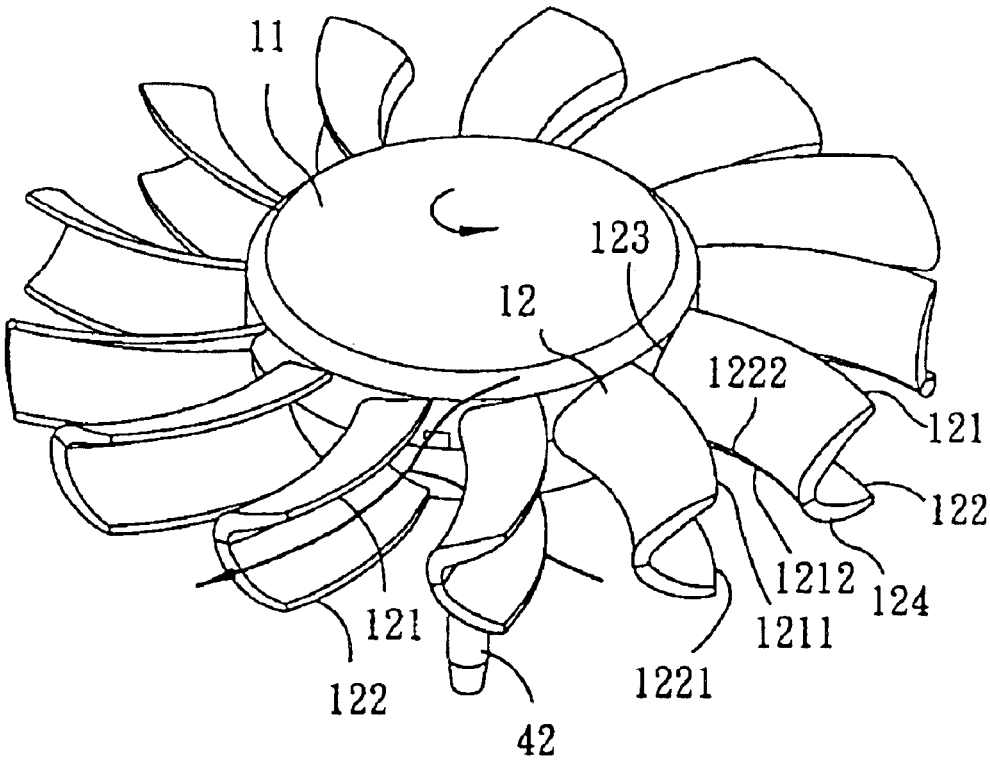
FIG. 4 is a perspective view to illustrate how air flow passes through an adjacent pair of impellers of the cooling fan of FIG. 3.

FIGS. 3 and 4 illustrate a preferred embodiment of a cooling fan 4 according to this invention for a notebook computer (not shown). The cooling fan 4 is made from a plastic material, and includes: a casing 40; a motor 41 mounted in the casing 40; a rotatable hub 11 mounted in the casing 40 and connected to an output shaft 42 of the motor 41 so as to be driven rotatably by the motor 41; and a plurality of generally V-shaped impellers 12 that are angularly displaced from each other and that extend outwardly from the hub 11. Each of the impellers 12 has first and second impeller halves 121, 122 that extend outwardly from the hub 11 and that are connected to each other so as to form cooperatively an angle θ therebetween.

Each of the impellers 12 has a root 123 connected to the hub 11, and a tip 124 opposite to the root 123. The first impeller half 121 has a first leading edge 1211 extending curvedly and outwardly from the root 123 to the tip 124, and a first trailing edge 1212 opposite to the first leading edge 1211 and extending curvedly and outwardly from the root 123 to the tip 124. The second impeller half 122 has a second leading edge 1221 extending curvedly and outwardly from the root 123 to the tip 124 and spaced apart from and substantially flush with the first leading edge 1211 in an axial direction relative to the hub 11, and a second trailing edge 1222 extending curvedly and outwardly from the root 123 to the tip 124 and connected to the first trailing edge 1212 to form the angle θ.

Figure 5:
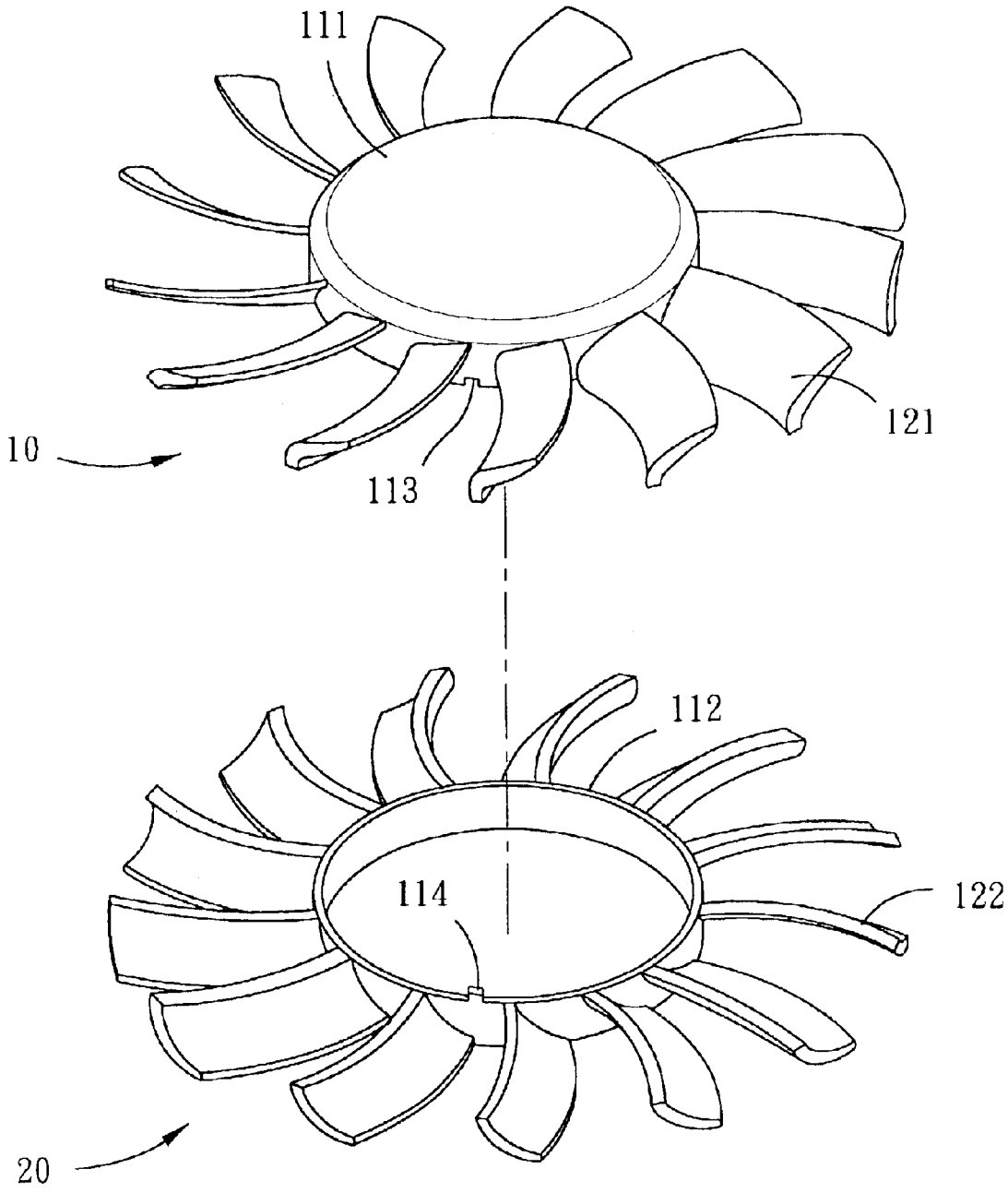
FIG. 5 is an exploded perspective view of two complementary halves of the cooling fan of FIG. 3.

Referring to FIG. 5, in combination with FIG. 4, the hub 11 includes first and second hub halves 111, 112. An interlocking member includes a plurality of grooves 113 which are formed in the first hub half 111, and a plurality of tongues 114 which are formed on the second hub half 112. The tongues 114 engage respectively the grooves 113 so as to secure the first and second hub halves 111, 112 together. The first impeller halves 121 of the impellers 12 are connected to and extend outwardly from the first hub half 111 so as to form a first fan half 10. The second impeller halves 122 of the impellers 12 are connected to and extend outwardly from the second hub half 112 so as to form a second fan half 20.

Figure 6:
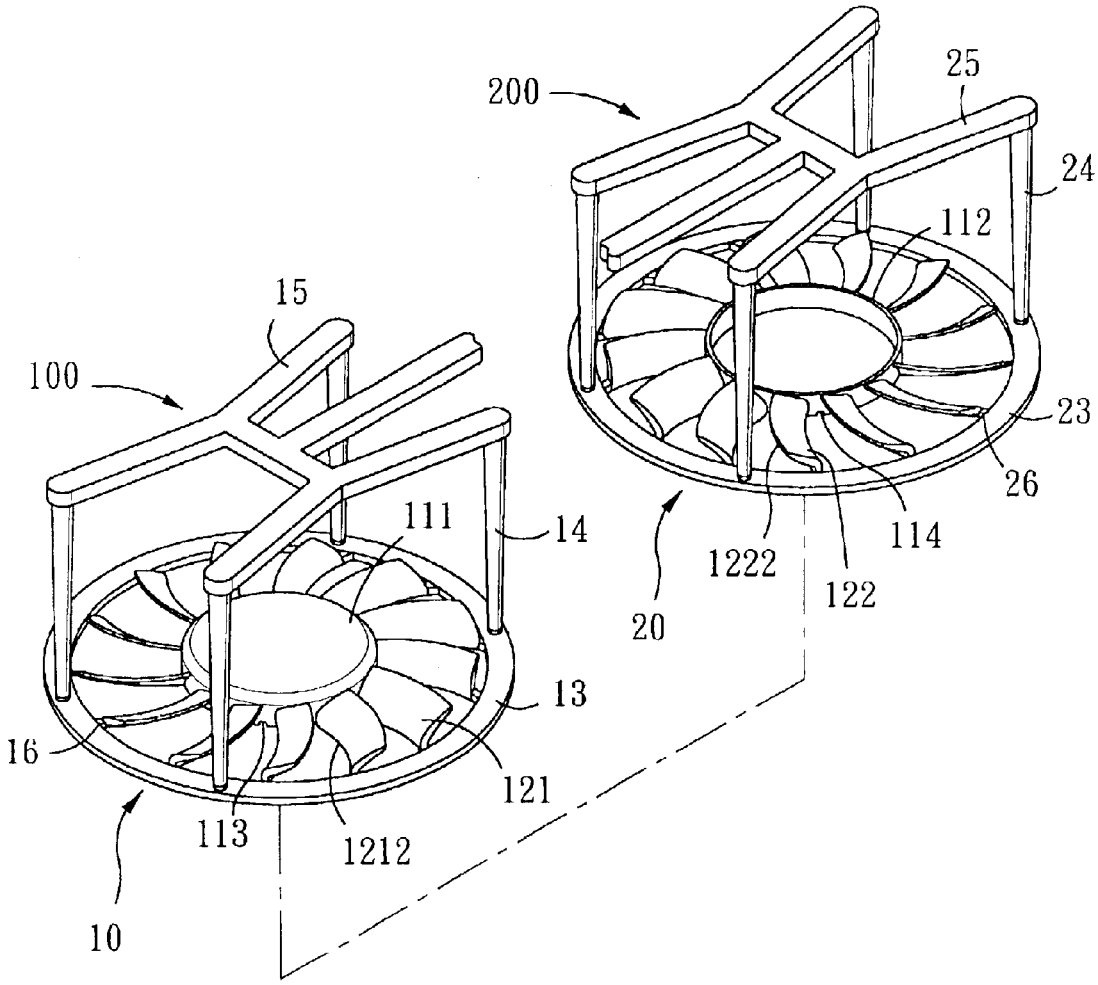
FIG. 6 is a perspective view to illustrate how the complementary halves of the cooling fan are formed.

Referring to FIG. 6, in combination with FIG. 5, the first hub half 111 and the first impeller halves 121 of the impellers 12 are integrally formed by molding. A first runner system 100 and a plurality of first gates 16, which are formed as a result of the molding process, are removed so as to form the first fan half 10. The first runner system 100 includes an outer portion 15, an axial portion 14, and an inner ring portion 13. The second hub half 112 and the second impeller halves 122 of the impellers 12 are also integrally formed by molding. A second runner system 200 and a plurality of second gates 26, which are formed as a result of the molding process, are removed so as to form the second fan half 20. The second runner system 200 includes an outer portion 25, an axial portion 24, and an inner ring portion 23. The first trailing edge 1212 of each of the first impeller halves 121 are integrally connected to the second trailing edge 1222 of a respective one of the second impeller halves 122 by high frequency welding.

Figure 1:
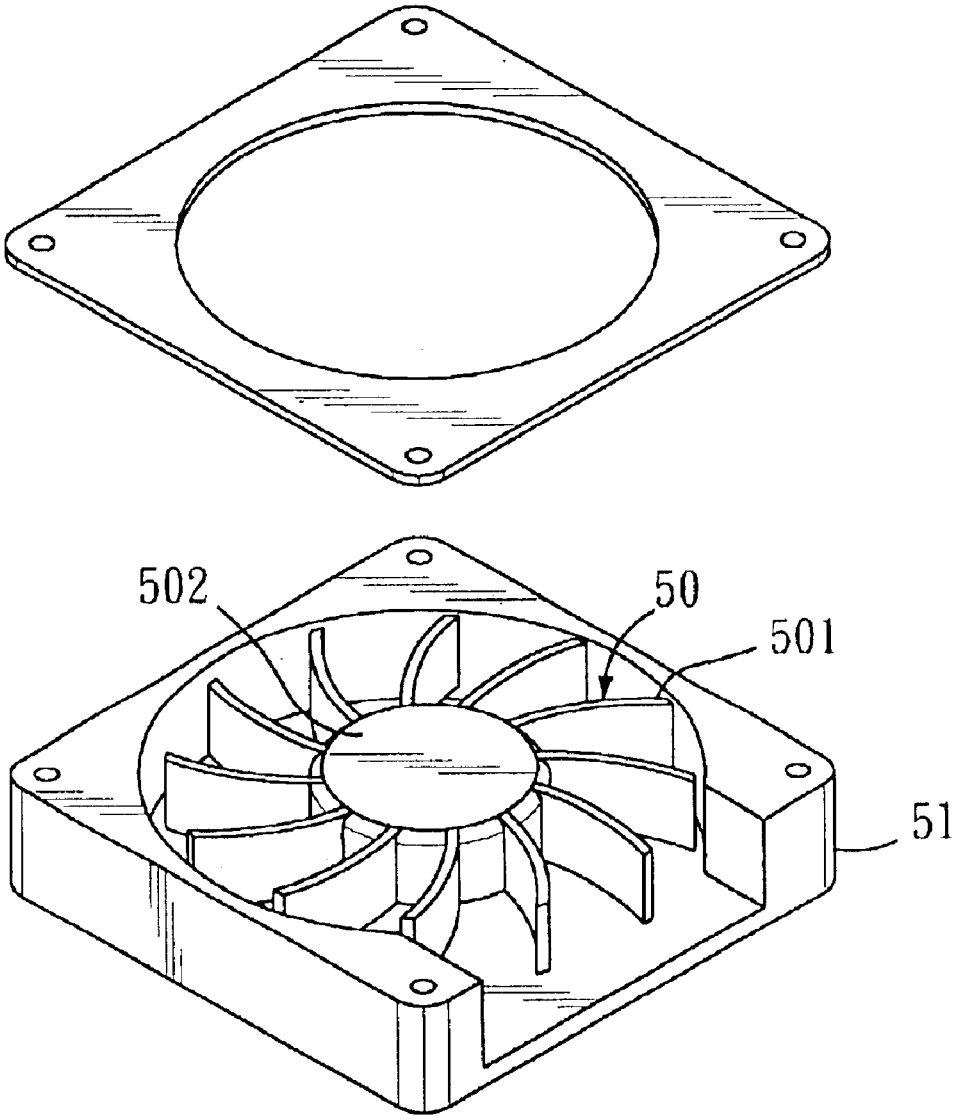
FIG. 1 PRIOR ART
FIG. 1 is a perspective view of a conventional centrifugal cooling fan.
Figure 2:
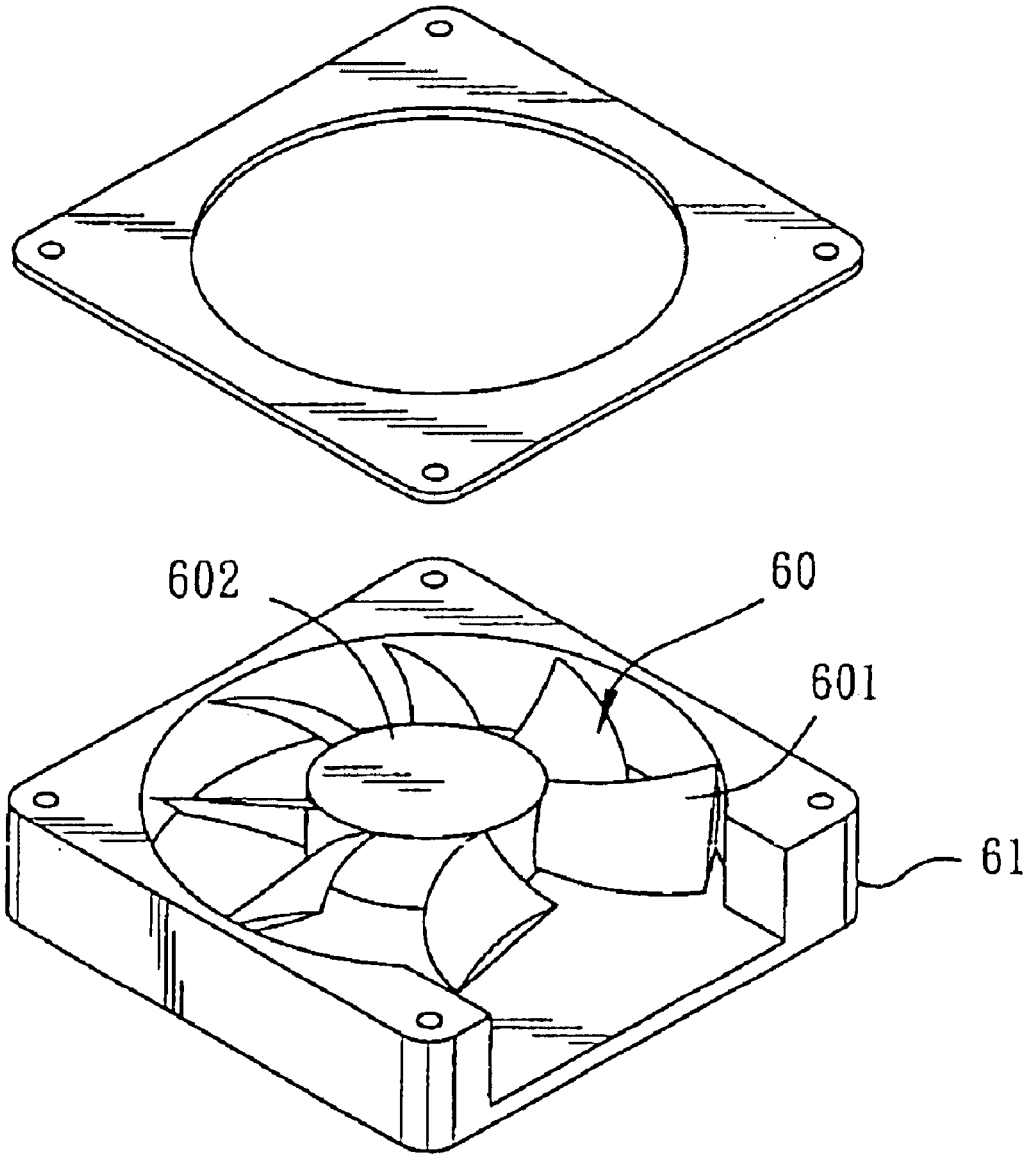
FIG. 2 PRIOR ART
FIG. 2 is a perspective view of a conventional axial cooing fan.

By virtue of the V-shaped impellers 12 of the cooling fan 4 of this invention, the aforesaid drawbacks as encountered in the prior art can be eliminated. Moreover, the V-shaped impellers 12 combines the structures and thus advantages of the conventional impellers of the axial cooling fan and the centrifugal impellers shown in FIGS. 1 and 2.

With the invention thus explained, it is apparent that various modifications and variations can be made without departing from the spirit of the present invention. It is therefore intended that the invention be limited only as recited in the appended claims.

I claim:

1. A cooling fan comprising:

a rotatable hub; and a plurality of generally V-shaped impellers that are angularly displaced from each other and that extend outwardly from said hub, each of said impellers having first and second impeller halves that extend outwardly from said hub and that are connected to each other so as to form cooperatively an angle therebetween, wherein each of the said impellers has a root connected to said hub, and a tip opposite to said root, said first impeller half having a first leading edge extending outwardly from said root to said tip, and a first trailing edge opposite to said first leading edge and extending outwardly from said root to said tip, said second impeller half having a second leading edge extending outwardly from said root to said tip and spaced apart from and substantially flush with said first leading edge in an axial direction relative to said hub, and a second trailing edge extending outwardly from said root to said tip and connected to said first trailing edge to form said angle.

2. A cooling fan comprising:

a rotatable hub; and a plurality of generally V-shaped impellers that are angularly displaced from each other and that extend outwardly from said hub, each of said impellers having first and second impeller halves that extend outwardly from said hub and that are connected to each other so as to form cooperatively an angle therebetween, wherein each of the said impellers has a root connected to said hub, and a tip opposite to said root, said first impeller half having a first leading edge extending curvedly and outwardly from said root to said tip, and a first trailing edge opposite to said first leading edge and extending curvedly and outwardly from said root to said tip, said second impeller half having a second leading edge extending curvedly and outwardly from said root to said tip and spaced apart from and substantially flush with said first leading edge in an axial direction relative to said hub, and a second trailing edge extending curvedly and outwardly from said root to said tip and connected to said first trailing edge to form said angle.

3. The cooling fan of claim 2, wherein said hub includes first and second hub halves, said cooling fan further comprising an interlocking member that includes a plurality of grooves which are formed in said first hub half, and a plurality of tongues which are formed on said second hub half, said tongues engaging respectively said grooves so as to secure said first and second hub halves together, said first impeller halves of said impellers being connected to and extending outwardly from said first hub half, said second impeller halves of said impellers being connected to and extending outwardly from said second hub half.

4. The cooling fan of claim 3, wherein said first hub half and said first impeller halves of said impellers are made from a plastic material and are integrally formed by molding, said second hub half and said second impeller halves of said impellers being made from said plastic material and being integrally formed by molding, said first trailing edge of each of said first impeller halves being integrally connected to said second trailing edge of a respective one of said second impeller halves by high frequency welding.

* * * * *